US008051993B1

(12) United States Patent
Tu

(10) Patent No.: US 8,051,993 B1
(45) Date of Patent: Nov. 8, 2011

(54) HEAD RAIL FOR AN ADJUSTABLE ROLLER SHADE

(76) Inventor: Kevin Tien-Jen Tu, Toronto (CA)

( * ) Notice: Subject to any disclaimer, the term of this patent is extended or adjusted under 35 U.S.C. 154(b) by 0 days.

(21) Appl. No.: 12/925,731

(22) Filed: Oct. 28, 2010

(51) Int. Cl.
*A47H 1/00* (2006.01)

(52) U.S. Cl. ..... 211/123

(58) Field of Classification Search ..... 211/123, 211/105.1, 105.3, 105.5, 105.6, 175; 248/214, 248/200.1, 251, 252, 254, 255, 261, 262, 248/266; 16/87.4 R, 87.6 R, 195 R; 160/330, 160/392, 395
See application file for complete search history.

(56) References Cited

U.S. PATENT DOCUMENTS 7,597,297 B2 * 10/2009 Isfeld et al. ..... 248/251
2002/0148796 A1 * 10/2002 Lin ..... 211/123
2002/0153337 A1 * 10/2002 Shuen ..... 211/123
2003/0111435 A1 * 6/2003 Chen ..... 211/123
2006/0070966 A1 * 4/2006 Koudys et al. ..... 211/105.3
2008/0099419 A1 * 5/2008 Costa et al. ..... 211/105.1
2009/0223917 A1 * 9/2009 Grant et al. ..... 211/105.4

* cited by examiner

*Primary Examiner* — Jennifer E. Novosad
(74) *Attorney, Agent, or Firm* — Charles E. Baxley

(57) ABSTRACT

A head rail for an adjustable roller shade has two tubes and an extension bar. Each one of the tubes is circular in section and has an adjustment slot and a fabric slot. The adjustment slot is longitudinally formed in a periphery of each one of the tubes. The extension bar is adjustably mounted in the tubes. The tubes are fastened on the extension bar with a short exposed portion of the extension bar to form a desired length of the head rail. Additionally, when the exposed portion of the extension bar is long, the head rail further has at least one connection sheath sleeved around the exposed portion to strengthen the head rail and prevent a shade fabric mounted in the fabric slot from being ruffled or twisted when the head rail is rotated.

5 Claims, 6 Drawing Sheets

HEAD RAIL FOR AN ADJUSTABLE ROLLER SHADE

BACKGROUND OF THE INVENTION

1. Field of the Invention

The present invention relates to a head rail for roller shade, and more particularly to a head rail having an adjustable length.

2. Description of the Related Art

Roller shades are common window coverings to provide privacy and regulate sunlight. A conventional roller shade has a flexible shade fabric windingly received on a head rail for raising and lowering the shade fabric by rotating the head rail. As such roller shade is quite structurally simple, people tend to purchase necessary parts to assemble a roller shade based on their own customized demand. To meet that particular demand, one critical consideration in choosing the assembling elements is that the length of the head rail must correspond to the width of the window to which the roller shade is to be mounted.

To facilitate the cutting of the head rail, the head rail is normally paper-made. Besides requiring an additional machine for cutting, another drawback of the paper-made head rail is that the head rail is often deflected at the center and when the head rail is long it inevitably cannot maintain its straightness due to the weight of the shade fabric. Such a drawback results in a crooked roller shade being unsightly, falling short in its blocking function, and subject to collapse. Moreover, a head rail that is not cut in accordance with the exact mounting condition is irrecoverable and fails the entire mounting of a roller shade.

SUMMARY OF THE INVENTION

An objective of the present invention is to provide a head rail capable of adjusting in length.

To achieve the foregoing objective, the head rail for adjustable roller shade has two tubes and an extension bar.

Each one of the tubes is circular in section and has a periphery, an inner wall and an adjustment slot. The adjustment slot has a sunken rail, an opening, a threaded hole and a fastener. The sunken rail is hollow, and is longitudinally formed on and protrudes inwardly from the inner wall of the tube. The opening is longitudinally formed through a portion of the periphery of the tube directly above the sunken rail, and has a width no larger than that of the sunken rail. The threaded hole is formed through the sunken rail and is adjacent to one end of the tube. The fastener is mounted through the threaded hole.

The extension bar is elongated, is adjustably mounted in the tubes, and has a center shaft, multiple wings and a rail holder. The center shaft is formed along an axial direction of the extension bar. The wings are formed on and radially and longitudinally protrude from the center shaft of the extension bar. Each one of the wings has a free edge contacting with the inner walls of the tubes. The rail holder has a stand portion and a holding portion. The stand portion is formed on and radially and longitudinally protrudes from the center shaft of the extension bar, and has a top. The holding portion is longitudinally formed on the top of the stand portion to slidably hold the sunken rail of the adjustment slot slid therein, and has a recessed bottom and two fences. The recessed bottom is longitudinally formed on the top of the stand portion and is selectively abutted against by the fastener. The fences are longitudinally formed on and protrude upwardly from two opposite sides of the recessed bottom and contact with the inner walls of the tubes.

Preferably, the head rail for adjustable roller shade further has at least one connection sheath being tubular, and made of a flexible material. Each one of the at least one connection sheath has a periphery, a gap and two holding edges. The gap is longitudinally formed through the periphery of the connection sheath and widened for the connection sheath to partially sleeve a portion of the extension bar exposed from the tubes through the gap. The holding edges are spaced by the gap, and respectively hold the free edges of the wings.

To implement a customized length slightly longer than the combined length of the tubes, the extended portion or the exposed portion of the extension bar is not significantly long. The combination of the tubes and the extension bar can achieve the demand without weakening the aesthetic appeal nor twisting the shade fabric. To implement a customized length significantly longer than the combined length of the tubes, besides the tubes and the extension bar, the at least one connection sheath is added to sleeve the exposed portion of the extension bar, not only taking the aesthetic concern into account but also reinforcing the strength of the exposed portion of the extension bar. Accordingly, the head rail can be easily and firmly adjusted to adapt to a customized length of the head rail.

Other objectives, advantages and novel features of the invention will become more apparent from the following detailed description when taken in conjunction with the accompanying drawings.

DETAILED DESCRIPTION OF THE INVENTION

Figure 1:
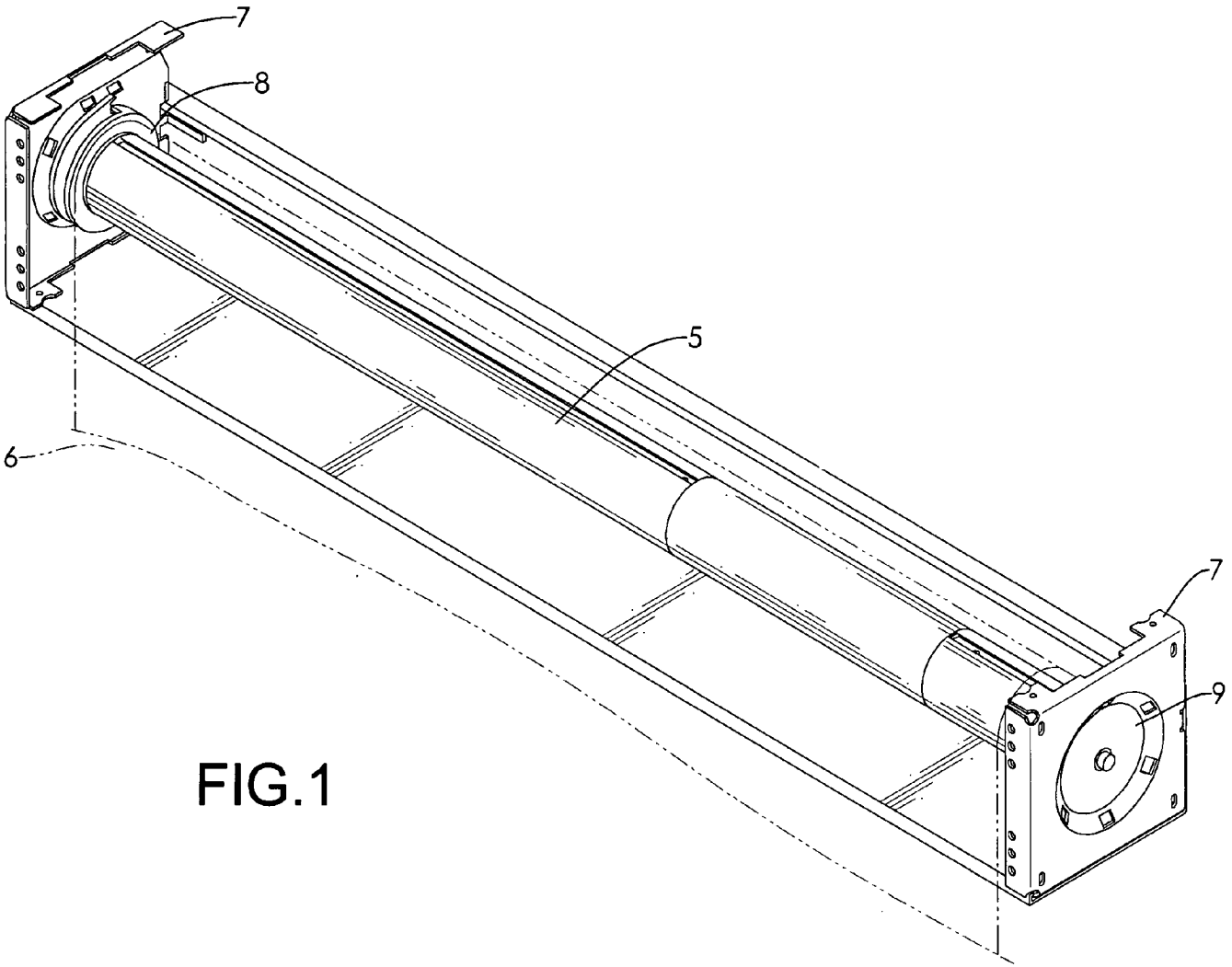
FIG. 1 is a perspective view of an adjustable roller shade with a head rail in accordance with the present invention.

With reference to FIG. 1, an adjustable roller shade may comprise a head rail 5, a shade fabric 6, two brackets 7, a clutch mechanism 8 and an idler mechanism 9.

The head rail 5 in accordance with the present invention is elongated and adjustable in length. The shade fabric 6 is attached to one of the slots longitudinally formed in the head rail 5 and windingly supported by the head rail 5. The brackets 7 are mounted at opposite ends of the head rail 5 for supporting the head rail 5 on a fixed surface such as a wall or ceiling. The clutch mechanism 8 is mounted between one of the brackets 7 and one end of the head rail 5, and rotatably drives the head rail 5 and prevents the head rail 5 from being back-driven. The idler mechanism 9 is mounted between the other bracket 7 and the other end of the head rail 5, and rotatably supports the head rail 5. The shade fabric 6, the brackets 7, the clutch mechanism 8 and the idler mechanism 9 may be conventional and detail description thereof is omitted.

Figure 2:
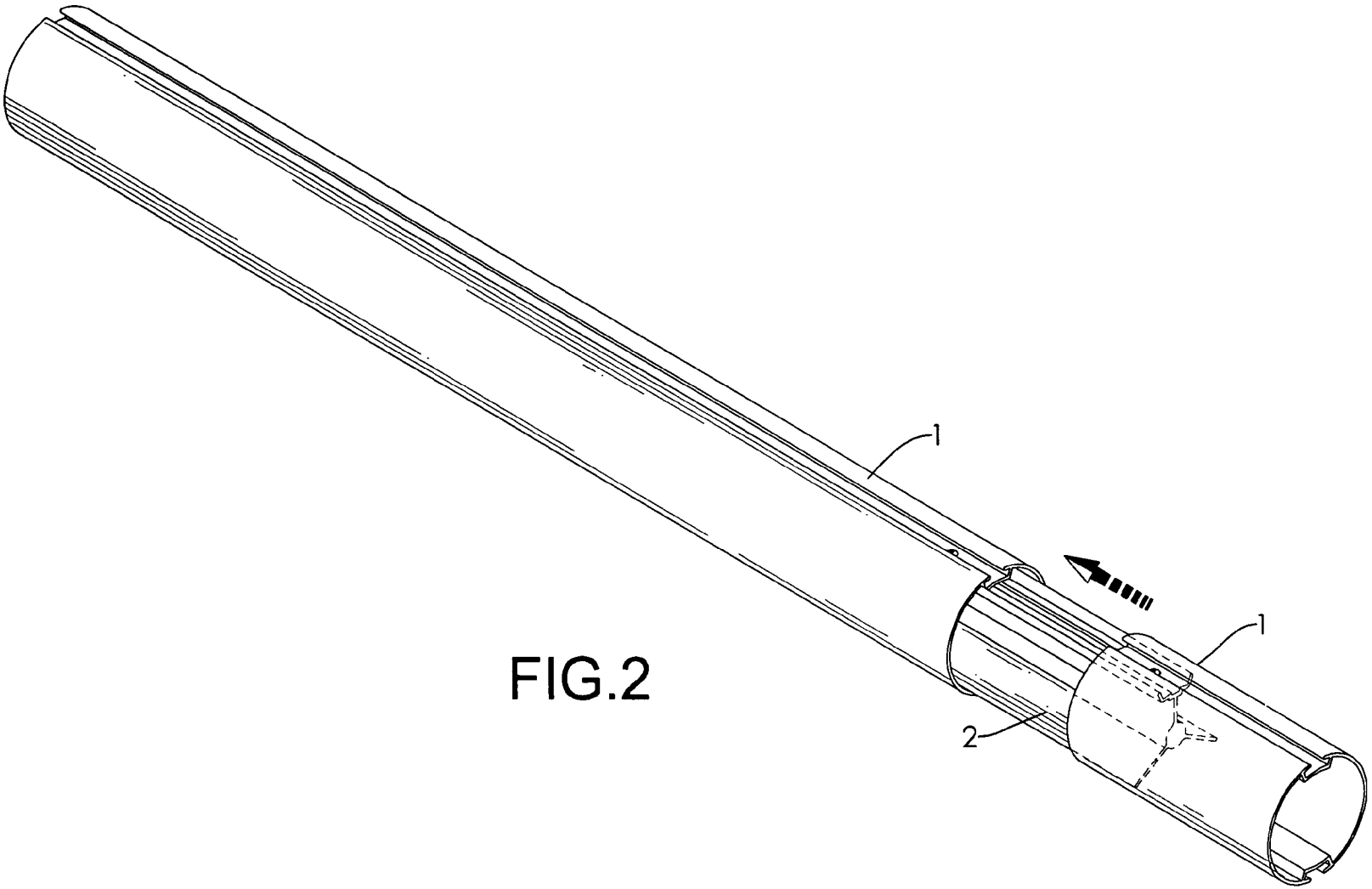
FIG. 2 is an operational perspective view of a first embodiment of a head rail for an adjustable roller shade in accordance with the present invention.
Figure 3:
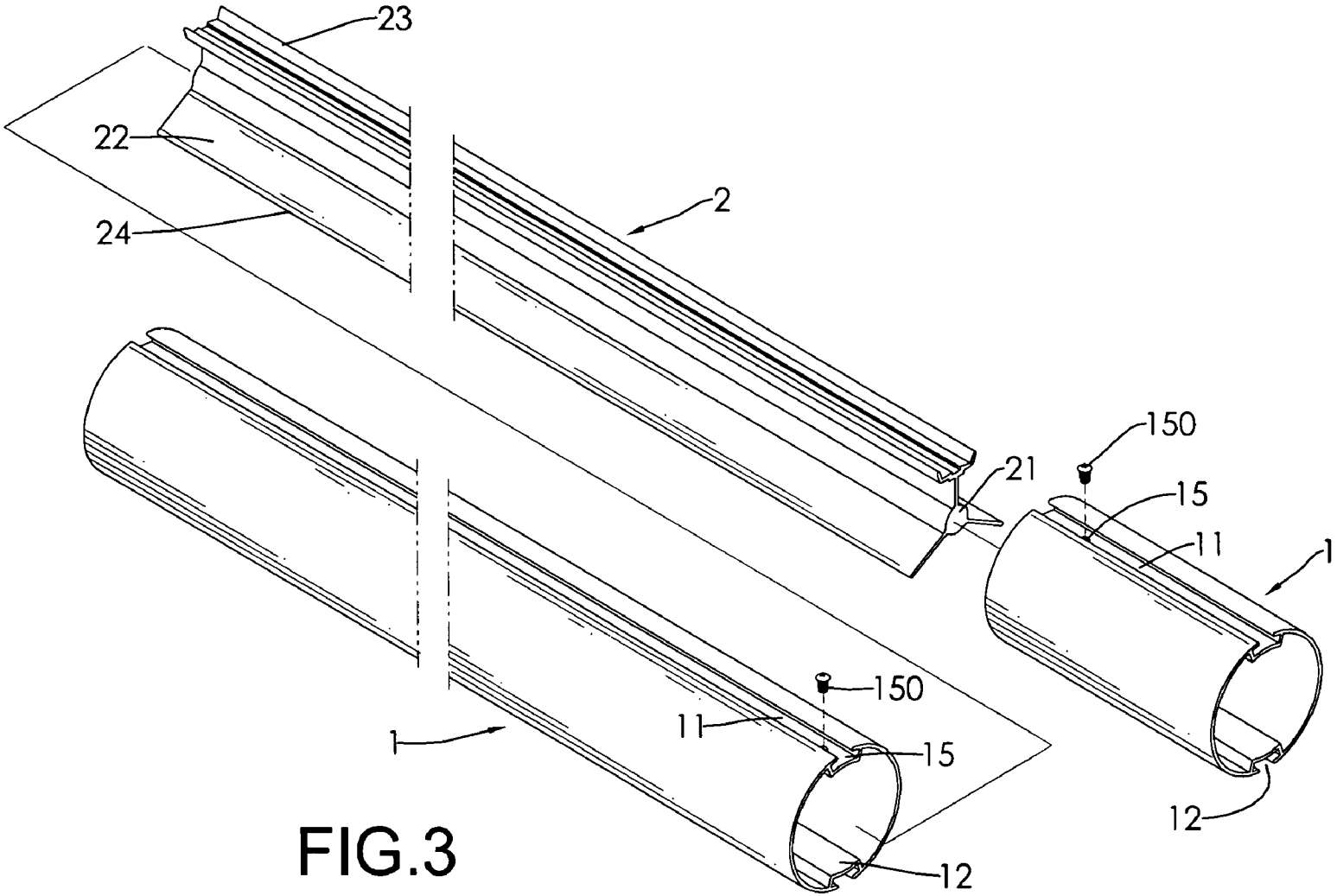
FIG. 3 is an exploded perspective view of the head rail in FIG. 2.
Figure 4:
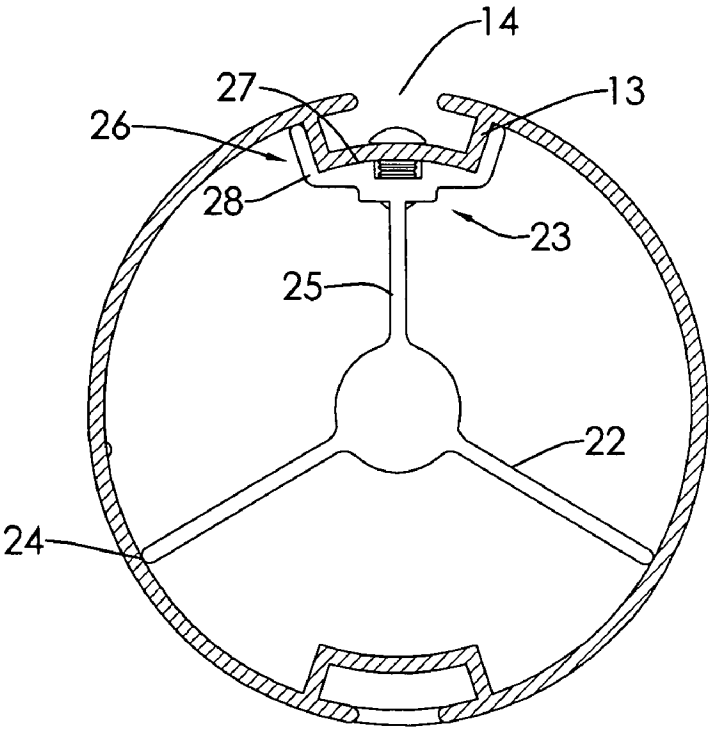
FIG. 4 is a side view in partial section of the head rail in FIG. 2.

With reference to FIGS. 2 to 4, a first embodiment of a head rail 5 in accordance with the present invention has two tubes and an extension bar 2.

Each one of the tubes 1 is circular in section and has an adjustment slot 11 and a fabric slot 12 oppositely and longitudinally formed in and recessed inwardly from a periphery of the tube 1. Each one of the adjustment slot 11 and the fabric slot 12 has a sunken rail 13 and an opening 14. The sunken rail 13 is hollow and longitudinally formed on and protrudes inwardly from an inner wall of the tube 1. The opening 14 is longitudinally formed through a portion of the periphery of the tube 1 directly above the sunken rail 13, and has a width no larger than that of the sunken rail 13. The adjustment slot 11 further has a threaded hole 15 formed through the sunken rail 13 and being adjacent to one end of the tube 1. The fabric slot 12 serves to be mounted with a shade fabric 6 therein as shown in FIG. 1 by squeezing the shade fabric 6 into the fabric slot 12 or applying adhesive in the fabric slot 12 to stick the shade fabric 6 to the fabric slot 12.

The extension bar 2 is elongated, is adjustably mounted in each one of the tubes 1, and has a central shaft 21, multiple wings 22 and a rail holder 23. The center shaft 21 is formed along an axial direction of the extension bar 2. The wings 22 are formed on and radially and longitudinally protrude from the central shaft 21. Each one of the wings 22 has a free edge 24 contacting with the inner walls of the tubes 1. The rail holder 23 has a stand portion 25 and a holding portion 26. The stand portion 25 is formed on and radially and longitudinally protrudes from the central shaft. The holding portion 26 is longitudinally formed on a top of the stand portion 25 to slidably hold the sunken rail 13 of the adjustment slot 11, and has a recessed bottom 27 and two fences 28. The recessed bottom 27 is longitudinally formed on the top of the stand portion 25. The two fences 28 are longitudinally formed on and protrude upwardly from two opposite sides of the recessed bottom 27 and contact with the inner walls of the tubes 1. In the present embodiment, the extension bar 2 has two wings 22.

The present embodiment targets at providing a head rail 5 having a desired length slightly longer than the combined length of the tubes 1. The assembling procedure of the present embodiment is described as follows. The rail holder 23 of the extension bar 2 is aligned with the sunken rails 13 of the tubes 1. The sunken rails 13 of the tubes 1 are slid into the rail holder 23 so that two ends of the extension bar 2 are received longitudinally and adjustable in the tubes 1. One of the tubes 1 is fastened on the extension bar 2 by screwing a bolt 150 through the threaded hole 15 in the tube 1 to abut against the recess bottom 27 of the rail holder 23 of the extension bar 2. If the combined length of the tubes 1 is shorter than a desired length, the tube 1 is pulled away from the other tube 1 and the extension bar 2 is extended out from the other tube 1, having an exposed portion of the extension bar 2 becoming an extended portion to be added to the combined length of the tubes 1. When the combined length of the tubes 1 and the exposed portion of the extension bar 2 is equal to the desired length, the other tube 1 is fastened on the extension bar 2 by screwing a bolt 150 through the threaded hole 15 in the tube 1 to abut against the recess bottom 27 of the rail holder 23 of the extension bar 2. The head rail 5 when finished with the assembly is shown in FIG. 2.

Figure 7:
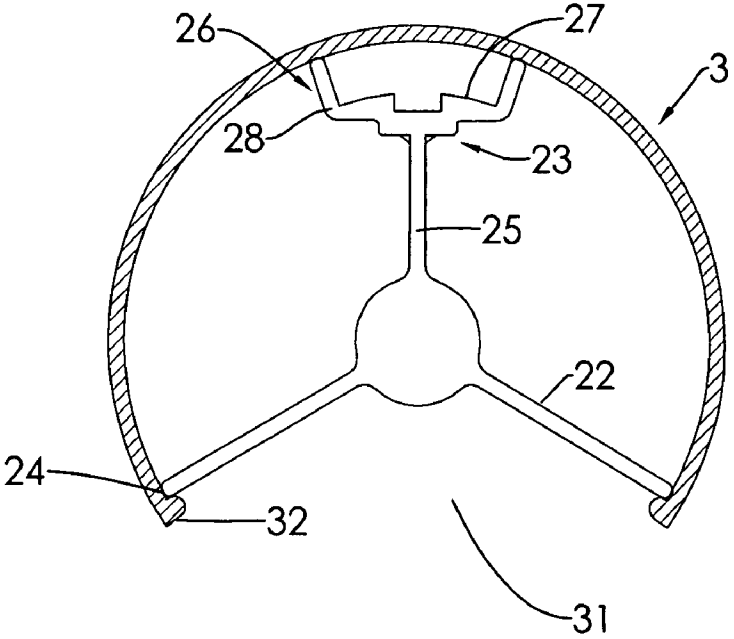
FIG. 7 is a side view in partial section of the head rail in FIG. 5.
Figure 5:
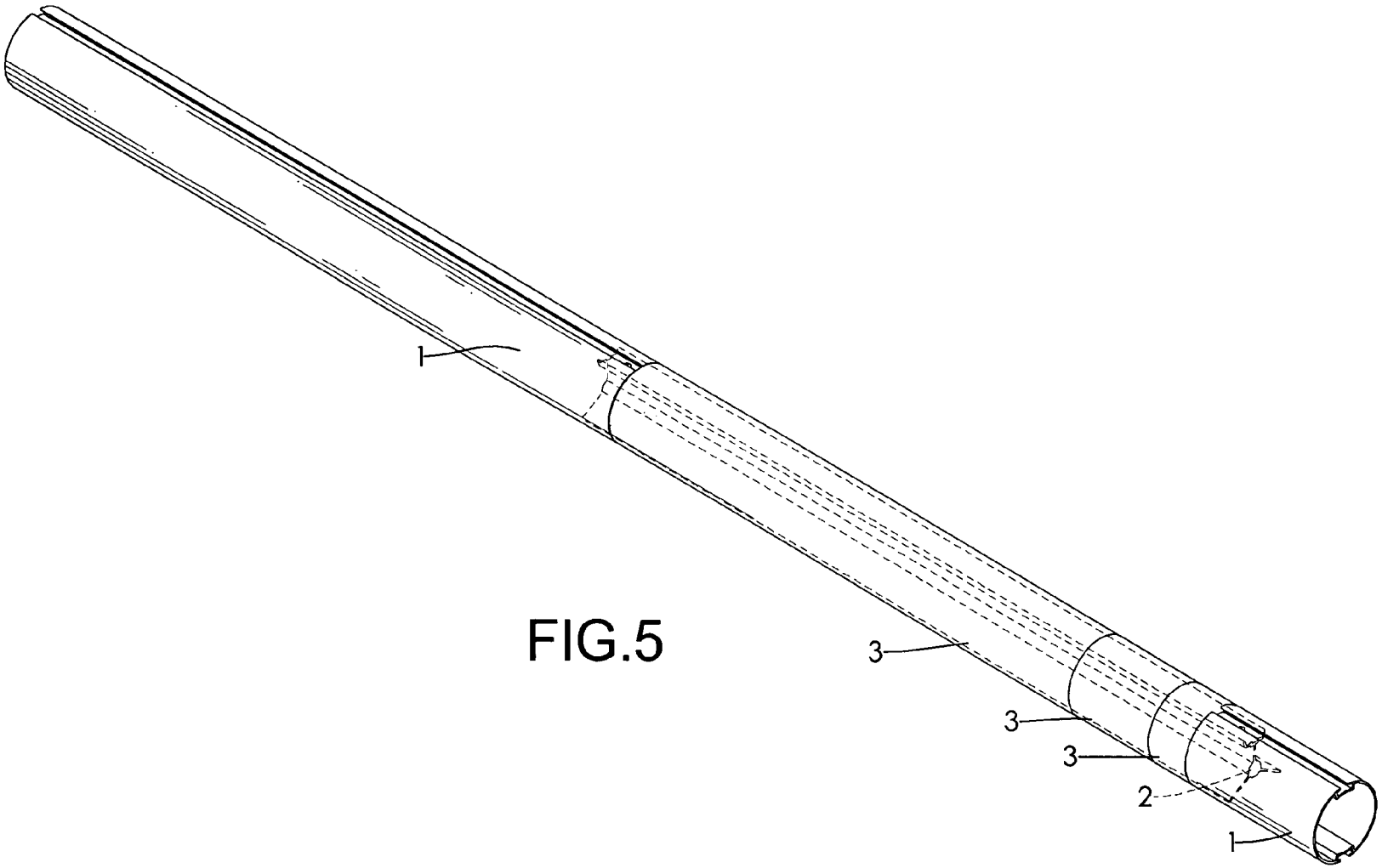
FIG. 5 is a perspective view of a second embodiment of the head rail for an adjustable roller shade in accordance with the present invention.
Figure 6:
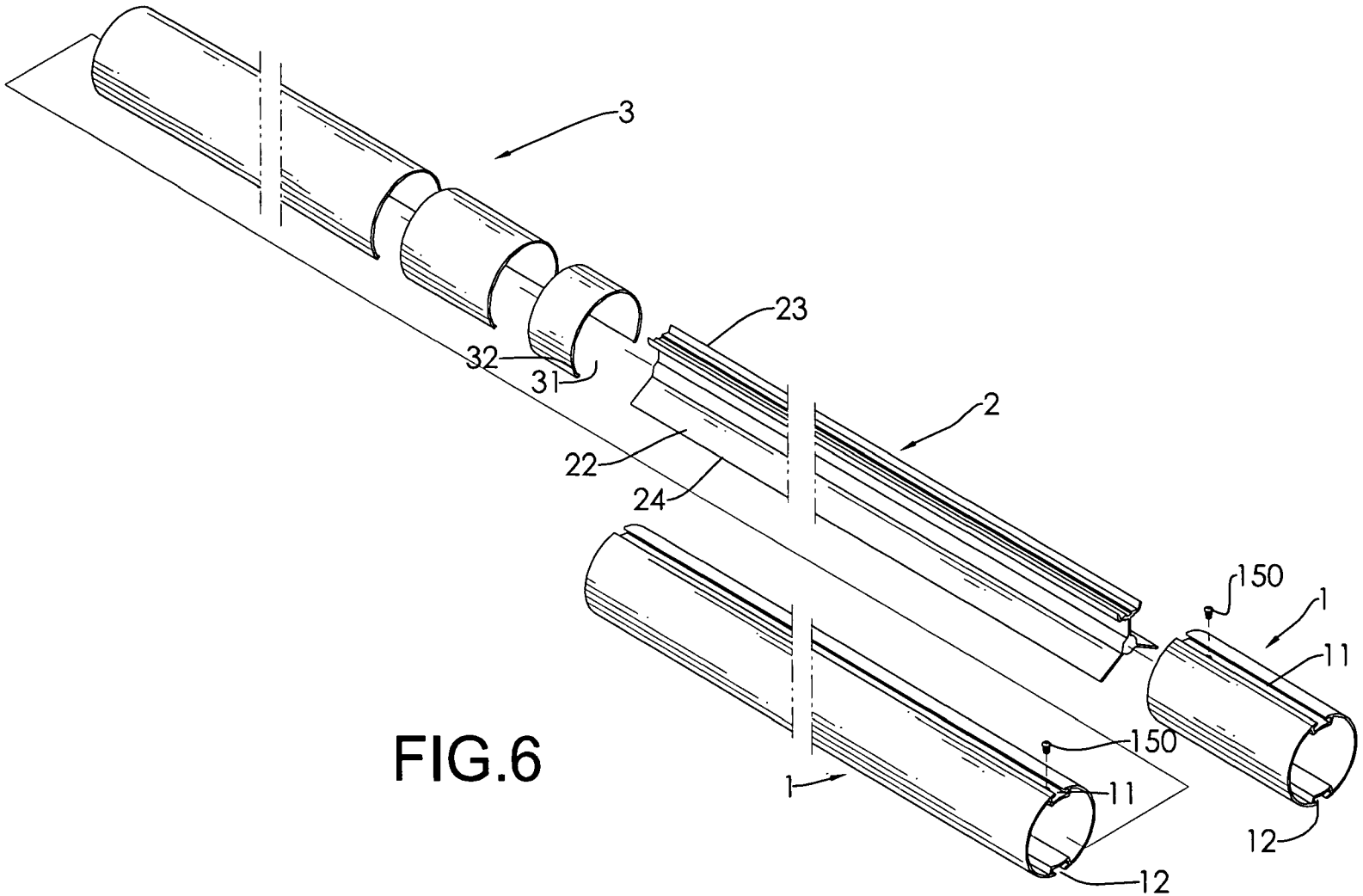
FIG. 6 is an exploded perspective view of the head rail in FIG. 5.

With reference to FIGS. 5 to 7, a second embodiment of the head rail 5 is shown. The difference between the present embodiment and the previous embodiment lies in that the present embodiment further has at least one connection sheath 3. Each one of the at least one connection sheath 3 is tubular, is made of a flexible material, and has a gap 31 and two holding edges 32. The gap 31 is longitudinally formed through a periphery of the connection sheath 3 and is widened for the connection sheath 3 to partially sleeve a portion of the extension bar 2 exposed from the tubes 1 through the gap. The holding edges 32 are spaced by the gap 31 and respectively hold the free edges 24 of the wings 22. In the present embodiment, the head rail 5 has three connection sheaths 3 and each one of the connection sheaths 3 has a different length.

The present embodiment targets at a head rail 5 having a desired length significantly longer than the combined length of the tubes 1. The assembling procedure of the present embodiment is exactly the same as that of the first embodiment in assembling the tubes 1 and the extension bar 2. The only difference between the present embodiment and the first embodiment lies in the exposed portion of the extension bar 2 in the present embodiment is significantly longer than that in the first embodiment. Since the exposed portion of the extension bar 2 is significantly long, depending on the length of the exposed portion of the extension bar 2, at least one connection sheath 3 is selectively mounted between the tubes 1 to sleeve around the exposed portion of the extension bar 2.

The two tubes 1, the extension bar 2 and connection sheath 3 can be combined into a head rail 5 having a desired length. To form a head rail 5 having a desired length slightly longer than the lengths of the tubes 1, the tubes 1 and the extension bar 2 can be combined to adjust the length. When the desired length of the head rail 5 is significantly longer than the combined length of the tubes 1, at least one connection sheath 3 can be selectively mounted between the tubes 1 to sleeve around the exposed portion of the extension bar 2. Accordingly, the head rail of the present invention eliminates the need of a machine for cutting, reinforces the head rail 5 and prevents the head rail 5 from being deflected when attached with a shade fabric, and prevents a shade fabric from being ruffled or even twisted by the head rail 5 when rotated.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A head rail for an adjustable roller shade, comprising:

two tubes, each one of the tubes being circular in section and having:

a periphery;

an inner wall; and an adjustment slot having:

a sunken rail being hollow, and longitudinally formed on and protruding inwardly from the inner wall of the tube;

an opening longitudinally formed through a portion of the periphery of the tube directly above the sunken rail, and having a width no larger than that of the sunken rail;

a threaded hole formed through the sunken rail and being adjacent to one end of the tube; and a fastener mounted through the threaded hole; and an extension bar being elongated, adjustably mounted in the tubes and having:

a center shaft formed along an axial direction of the extension bar;

multiple wings formed on and radially and longitudinally protruding from the center shaft of the extension bar, each one of the wings having a free edge contacting with the inner walls of the tubes; and a rail holder having:

a stand portion formed on and radially and longitudinally protruding from the center shaft of the extension bar, and having a top; and a holding portion longitudinally formed on the top of the stand portion to slidably hold the sunken rail of the adjustment slot slid therein, and having:

a recessed bottom longitudinally formed on the top of the stand portion and selectively abutted against by the fastener; and two fences longitudinally formed on and protruding upwardly from two opposite sides of the recessed bottom and contacting with the inner wall of the tubes.

2. The head rail for adjustable roller shade as claimed in claim 1, wherein each one of the tubes further has a fabric slot adapted to be mounted with a shade fabric therein.

3. The head rail for adjustable roller shade as claimed in claim 1 further comprising:

at least one connection sheath being tubular, and made of a flexible material, each one of the at least one connection sheath having:

a periphery;

a gap longitudinally formed through the periphery of the connection sheath and widened for the connection sheath to partially sleeve a portion of the extension bar exposed from the tubes through the gap; and two holding edges spaced by the gap, and respectively holding the free edges of the wings.

4. The head rail for adjustable roller shade as claimed in claim 2 further comprising:

at least one connection sheath being tubular, mounted between the tubes, and made of a flexible material, each one of the at least one connection sheath having:

a periphery;

a gap longitudinally formed through the periphery of the connection sheath and widened for the connection sheath to partially sleeve a portion of the extension bar exposed from the tubes through the gap; and two holding edges spaced by the gap, and respectively holding the free edges of the wings.

5. The head rail for adjustable roller shade as claimed in claim 3 further comprising:

at least one connection sheath being tubular, mounted between the tubes, and made of a flexible material, each one of the at least one connection sheath having:

a periphery;

a gap longitudinally formed through the periphery of the connection sheath and widened for the connection sheath to partially sleeve a portion of the extension bar exposed from the tubes through the gap; and two holding edges spaced by the gap, and respectively holding the free edges of the wings.

* * * * *